US005199359A

United States Patent [19]

Bedard et al.

[11] Patent Number: 5,199,359

[45] Date of Patent: Apr. 6, 1993

[54] STEERABLE RAIL-BOGIE

[75] Inventors: Jean Bedard, Charlesbourg; Jacques Viens, Roxton Pond, both of Canada

[73] Assignee: Innotermodal Inc., Quebec, Canada

[21] Appl. No.: 885,785

[22] Filed: May 20, 1992

[51] Int. Cl.[5] ..... B61F 5/30

[52] U.S. Cl. ..... 105/168; 105/4.1; 105/199.1; 105/222

[58] Field of Search ..... 105/167, 168, 3, 224.1, 105/4.1, 218.1, 199.1, 136, 222, 225, 165

[56] References Cited

U.S. PATENT DOCUMENTS

| | | | |
|---|---|---|---|
| 1,744,986 | 1/1930 | Richards | 105/168 |
| 4,170,179 | 10/1979 | Vogel | 105/168 |
| 4,416,571 | 11/1983 | Krause | 410/53 |
| 4,625,652 | 12/1986 | Losa et al. | 105/4.1 |
| 4,685,399 | 11/1987 | Baker | 105/4.1 |
| 4,802,418 | 2/1989 | Okamoto et al. | 105/168 |
| 4,903,613 | 2/1990 | Lang et al. | 105/167 |
| 4,938,151 | 7/1990 | Viens | 105/4.3 |
| 4,982,671 | 1/1991 | Chollet et al. | 105/168 |
| 4,986,191 | 1/1991 | Ragueneau et al. | 105/168 |

FOREIGN PATENT DOCUMENTS

| | | | |
|---|---|---|---|
| 0387744 | 9/1990 | European Pat. Off. | 105/168 |
| 0392414 | 10/1990 | European Pat. Off. | 105/167 |
| 2419989 | 11/1975 | Fed. Rep. of Germany | 105/168 |
| 2624719 | 11/1977 | Fed. Rep. of Germany | 105/168 |
| 9200213 | 1/1992 | PCT Int'l Appl. . | |
| 1351822 | 11/1987 | U.S.S.R. | 105/168 |

*Primary Examiner*—Mark T. Le
*Attorney, Agent, or Firm*—Edwin E. Greigg; Ronald E. Greigg

[57] ABSTRACT

A twin-axle rail-bogie which incorporates a steering mechanism for positively steering one or both of the axles of the rail-bogie in proportion to the rotation of the frame of a structure supported by this rail-bogie. Steering is achieved by slidably mounting one of the axle end supporting assemblies onto the chassis of the bogie so that this assembly is longitudinally slidable and thus causes the one axle having one of its ends connected thereto to pivot forwards or rearwards out of its normal transverse position relative to the transversally opposite supporting assembly which holds the other end of the one axle and then acts as a pivot. An operating arm attached to the frame near the one supporting assembly is used for moving via a linking mechanism the one supporting assembly in such a direction as to cause the one axle held by this supporting assembly to pivot in the same direction but at an angle smaller than and proportional to the frame with respect to the chassis of the bogie.

7 Claims, 7 Drawing Sheets

STEERABLE RAIL-BOGIE

BACKGROUND OF THE INVENTION

The present invention is concerned with an improvement to the basic structure of a twin-axle rail-bogie.

More particularly, the invention is concerned with the incorporation of a steering mechanism to a twin-axle rail-bogie for steering one or both of the axles of this rail-bogie in proportion to the rotation of the frame of a structure supported by this rail-bogie. Such a supported structure may, in practice, be the platform of a conventional wagon or the front or rear end of a semi-trailer when the rail-bogie is adapted for hooking with semi-trailers to form a train for riding on rails.

BRIEF DESCRIPTION OF THE PRIOR ART

It is of very conventional practice for the platform of a rail-road wagon to be pivotably mounted on a pair of longitudinally spaced apart, twin-axle rail-bogies of conventional structure.

In the recent years, twin-axle rail-bogies have also been devised, for hooking with semi-trailers or similar road vehicles, to form a train for riding on rails. In this connection, reference can be made to U.S. Pat. Nos. 4,416,571; 4,547,107 and 4,685,399. Reference can also be made to U.S. Pat. No. 4,938,151 and international laid-open patent application No. WO 92/00213 both belonging to the Applicant.

To the Applicant's knowledge, most of the twin-axle rail-bogies that are presently in use, have their axles that are so mounted as to remain permanently in a position transversal to the longitudinal axis of their chassis. In other words, there is presently no twin-axle rail-bogies available, at least to the Applicant's knowledge, which have one or both of their axles mounted so as to be positively steerable with respect to their chassis in order to follow as smoothy as possible the curvature of the rails on which they ride.

OBJECT AND SUMMARY OF THE INVENTION

The object of the invention is to provide an improved twin-axle rail-bogie, preferably although not exclusively for use to hook with semi-trailers to form a train for riding on rails, in which one and preferably both axles are steerable in proportion to the rotation of the frame of a platform or a semi-trailer pivotably mounted on its chassis.

The improved twin-axle rail-bogie according to the invention is of the type comprising:

a chassis having a longitudinal axis;

a pair of railboard wheel assemblies each comprising an axle normally in a transverse position and on which a pair of rail-engaging wheels are mounted;

first mounting means consisting of four similar axle end supporting assemblies for mounting the wheel assemblies comprising a journal box in which one end of one of the axles is mounted, and a box-supporting member onto which the journal box is connected through a resilient bushing; and second mounting means for pivotably mounting at least one semi-trailer or wagon frame on top of the chassis so that each frame may be free to rotate about a vertical axis intersecting the longitudinal axis.

In accordance with the invention, this rail-bogie is improved in that it further comprises means for steering one of the wheel assemblies proportionally to the degree of rotation about the vertical axis of one of the frame(s) pivotably mounted on top of the chassis.

These steering means includes slide means forming an integral part of the first mounting means, for slidably mounting one of the axle end supporting assemblies onto the chassis so that this one supporting assembly be longitudinally slidable and thus cause the one axle having one of its ends connected thereto to pivot forward or rearwards out of its normal transverse position about the transversally opposite supporting assembly holding the other end of the one axle, this opposite supporting assembly acting as a pivot thanks to its resilient bushing which gives some slack to the journal box in which the other end of the one axle is mounted.

The steering means also includes an operating arm having one end attached to the one frame close to the one supporting assembly slidably mounted onto the chassis, at a distance away from the vertical rotation axis of said one frame, and another end connected via a linking mechanism to the slide means, for moving the one supporting assembly in such a direction as to cause the one axle held by this one supporting assembly to pivot in the same direction but at a smaller angle than the one frame with respect to the chassis.

Preferably, the linking mechanism comprises:

an operating lever extending generally vertically and having an upper end pivotably connected to he other end of the operating arm, and a lower end pivotably fixed to the chassis; and a connecting link having one end pivotably connected to the operating lever between the upper and lower end thereof, and another end connected to the one supporting assembly slidably mounted onto the chassis.

Then, the required proportional steering may easily be achieved by proper selection of the location where the one end of the connecting link is connected to the operating lever between the upper and lower ends thereof, and by proper selection of the location where the covering lever is connected to the frame.

The invention, its operation and its advantages will be better understood upon reading of the following non-restrictive description of a preferred embodiment thereof, made with reference to the accompanying drawings.

DESCRIPTION OF A PREFERRED EMBODIMENT

The twin-axle rail assembly 1 according to the invention as shown in the accompanying drawings is of the type disclosed and claimed in international laid-open patent application No. WO 92/00213 published on Jan. 9, 1992 in the name of the Applicant.

Figure 6:
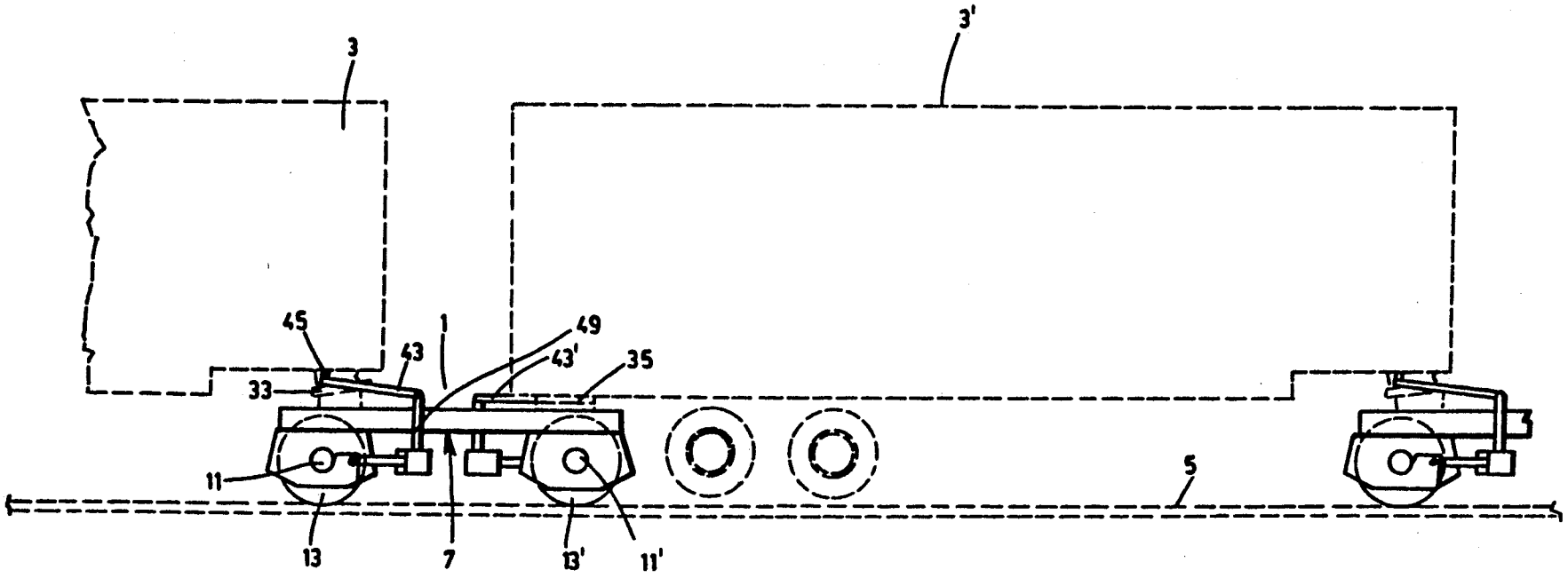
FIG. 6 is a side elevational view of a portion of a train formed of semi-trailers hooked onto rail-bogies as shown in FIGS. 1 to 5.
Figure 7:
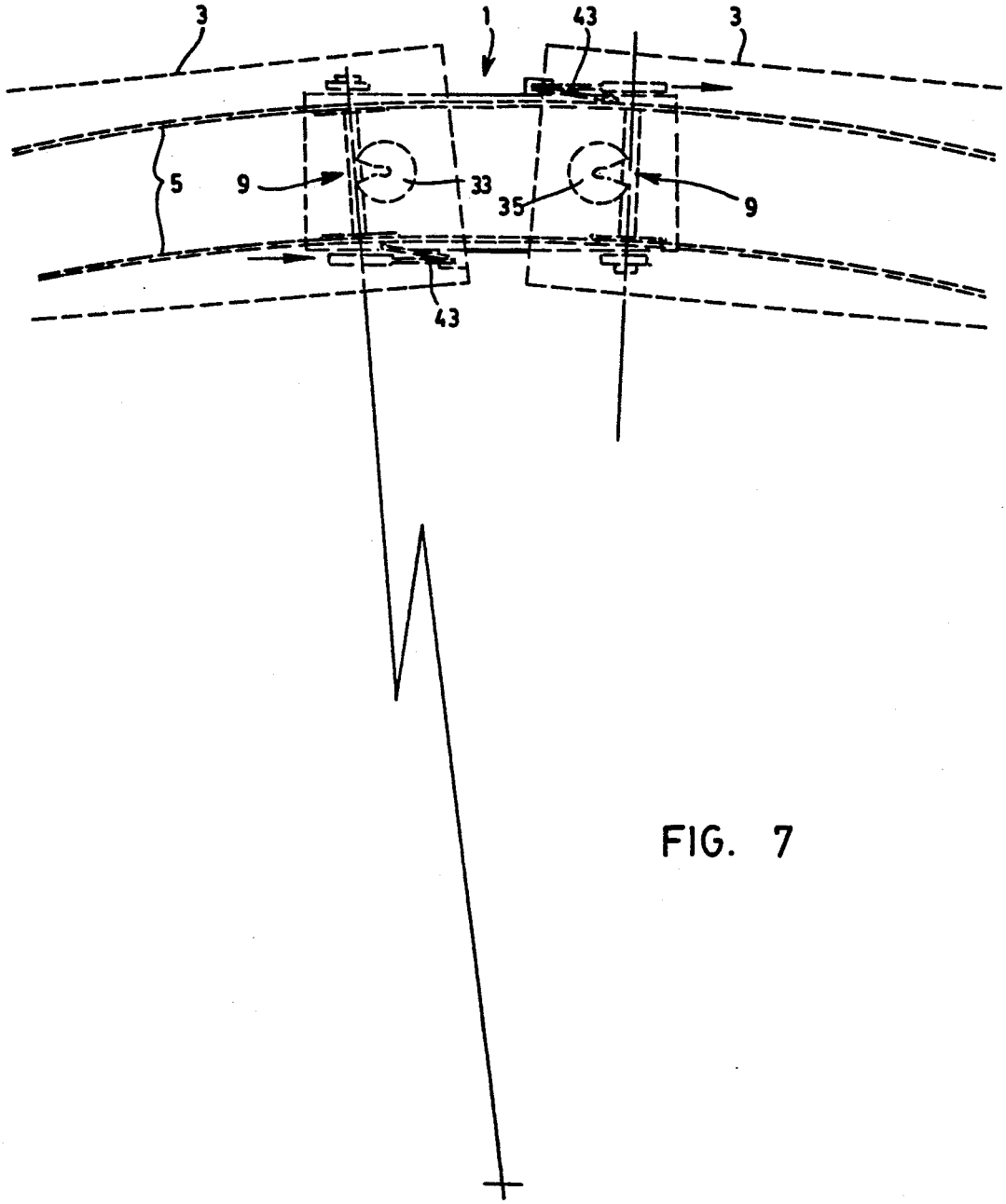
FIG. 7 is a top plan view of a rail-bogie of the train shown in FIG. 6, when it rides in a curve.
Figure 8:
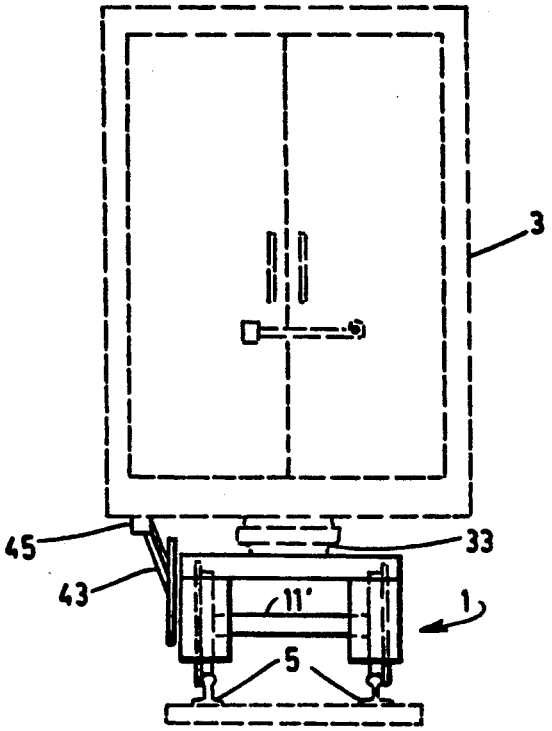
FIG. 8 is a rear elevational view of a semi-trailer hooked to a rail-bogie.

This rail-bogie 1 is devised for hooking with semi-trailers 3,3' or the like road vehicles (see FIGS. 6 to 8), in order to form a train for riding on rails 5. It comprises a chassis 7 having a pair of longitudinal side beams 8, 8' symmetrical with respect to a longitudinal axis. It also comprises a pair of railroad wheel assemblies 9, 9' extending under the chassis, each assembly comprising an axle 11, 11' normally in a transverse position, on which a pair of rail-engaging wheels 13, 13' are keyed.

First mounting means consisting of four axle end supporting assemblies 15, 17, 19 and 21, are provided for mounting the wheel assemblies 9, 9' under the chassis 7. Each of the supporting assemblies comprises a bearing structure 29 connected to the chassis, a journal box 23 in which one end of one of the axles 11, 11' is mounted, and a box-supporting member 25 onto which the journal box 23 is connected through a resilient bushing 27. The box-supporting member 25 has one end pivotably mounted on the bearing structure 29 about a pivot axis 31 extending parallel to the axle 9 or 9' mounted in the journal box 23, and another end pivotably connected to the lower end of a shock absorber 31' connected by its upper end to the bearing structure.

Second mounting means are also provided on the chassis for pivotably mounting the rear end of a first semi-trailer 3 simultaneously with the front end of another adjacent semi-trailer 3' on top of the chassis so that the frame of each of these semi-trailers 3, 3' can be free to rotate about a vertical axis intersecting the longitudinal axis of the bogie.

Figure 1:
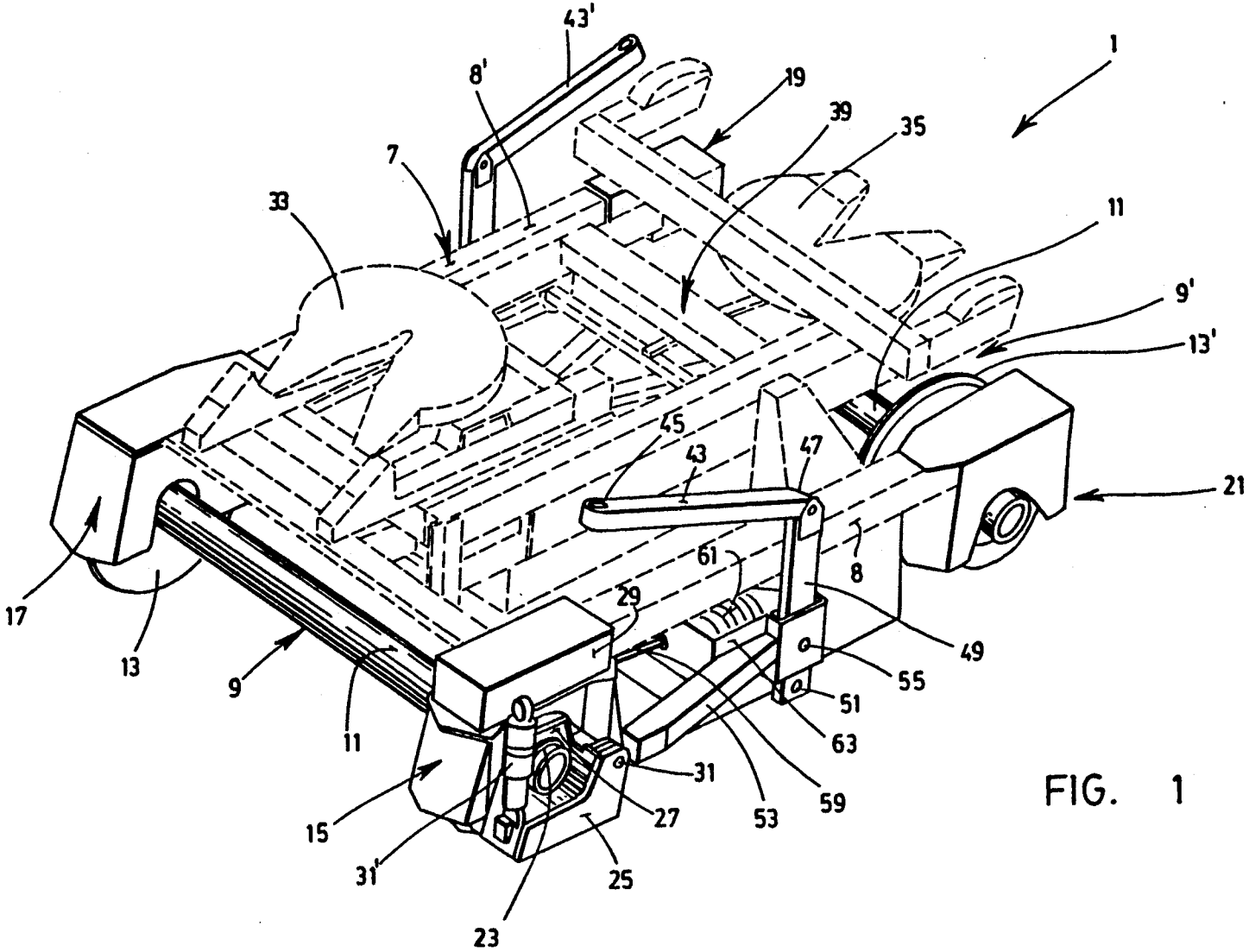
FIG. 1 is a perspective view of a twin-axle rail-bogie according to the invention, provided with means for steering its front and rear wheel assemblies.

As is better shown in FIG. 1, the second mounting means comprises first and second fifth wheels 33, 35 mounted on the chassis 7, these first and second fifth-wheels being oppositely oriented and vertically movable. The first fifth wheel 33 is intended to be interlocked with the front king pin of the semi-trailer 3 while the second fifth-wheel 35 is intended to be interlocked with a king pin centrally fixed to the rear end of the frame of the semi-trailer 3'.

Means are provided for moving the first and second fifth-wheels 33, 35 vertically between a low position and a high position relative to the chassis. These means preferably consist of power jacks or balloons (not shown) extending between the floor 37 (see FIGS. 2 and 3) of the chassis 1 and a vertically movable, fifth-wheels supporting frame 39 (see FIG. 1).

Means are also provided for releasably looking the frame 39 supporting the first and second fifth-wheels 33, 35 in its high position, relative to the chassis.

All of these means forming the second mounting means and the way they work and cooperate are disclosed in great detail in the above mentioned international laid-open patent application. Accordingly, there is no necessity to describe them further hereinafter.

In accordance with the invention, means are provided on the bogie for steering one and preferably both wheel assemblies proportionally to the degree of rotation of the frames of the semi-trailers 3, 3' pivotably mounted on top of the chassis 7, with respect to the frame of the bogie.

As better shown in FIGS. 2 to 5, these steering means include slide means forming an integral part of the first mounting means, for slidably mounting one of the axle end supporting assemblies, say 15, onto the chassis 7 so that this assembly 15 can be longitudinally slidable and thus cause the axle 9 having one of its ends connected thereto to pivot forwards or rearwards out of its normal transverse position about a pivot point which, in this particular case, consists of the transversally opposite supporting assembly 17 holding the other end of the same axle 9. Such a pivotal motion of the axle 9 is allowed by the resilient bushing 27 of the supporting assembly 17 acting as a pivot point, which gives some slack to the journal box 23 in which the other end of the axle 9 is mounted.

Figure 4:
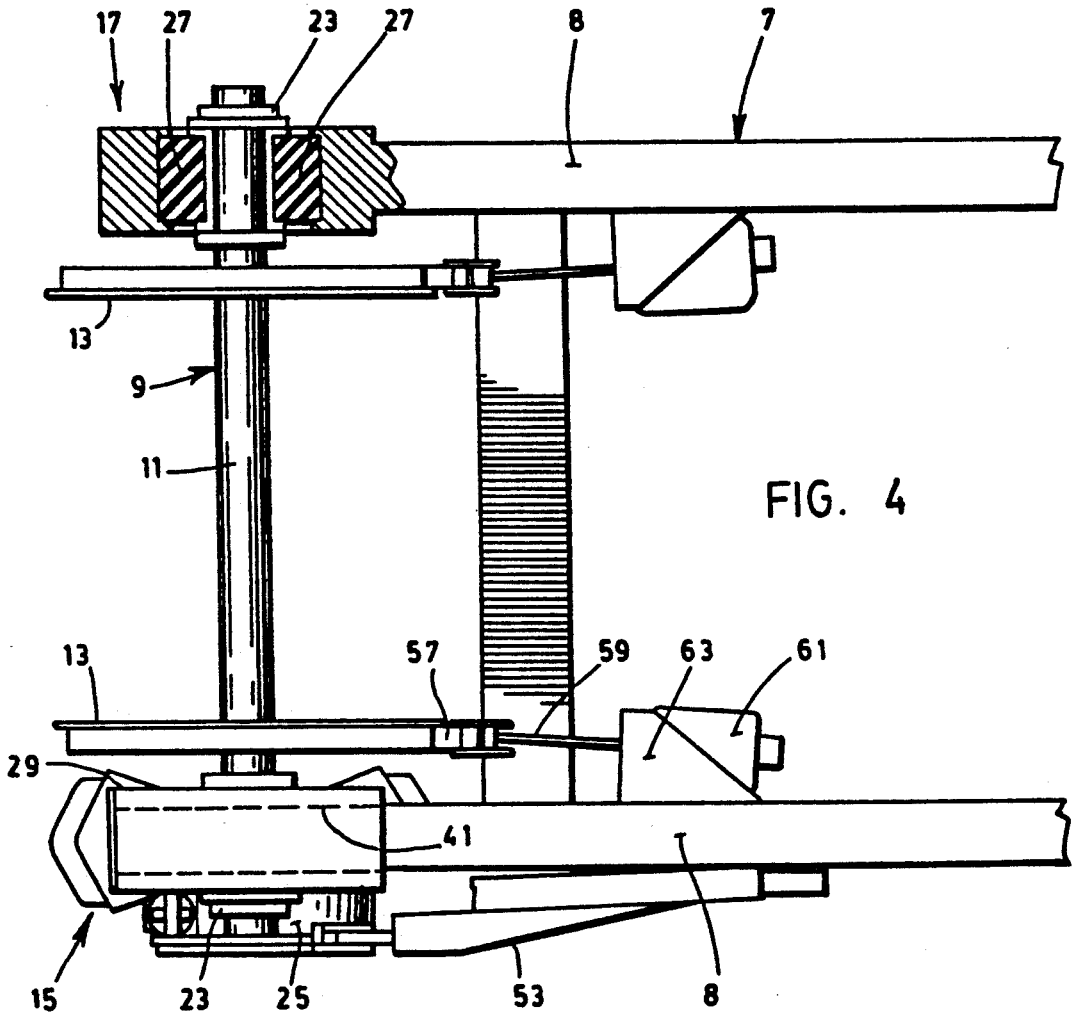
FIG. 4 is a top plan view in partial cross-section of the chassis and front wheel assembly of the rail-bogie of FIG. 1, when this assembly is in its normal transverse position.
Figure 5:
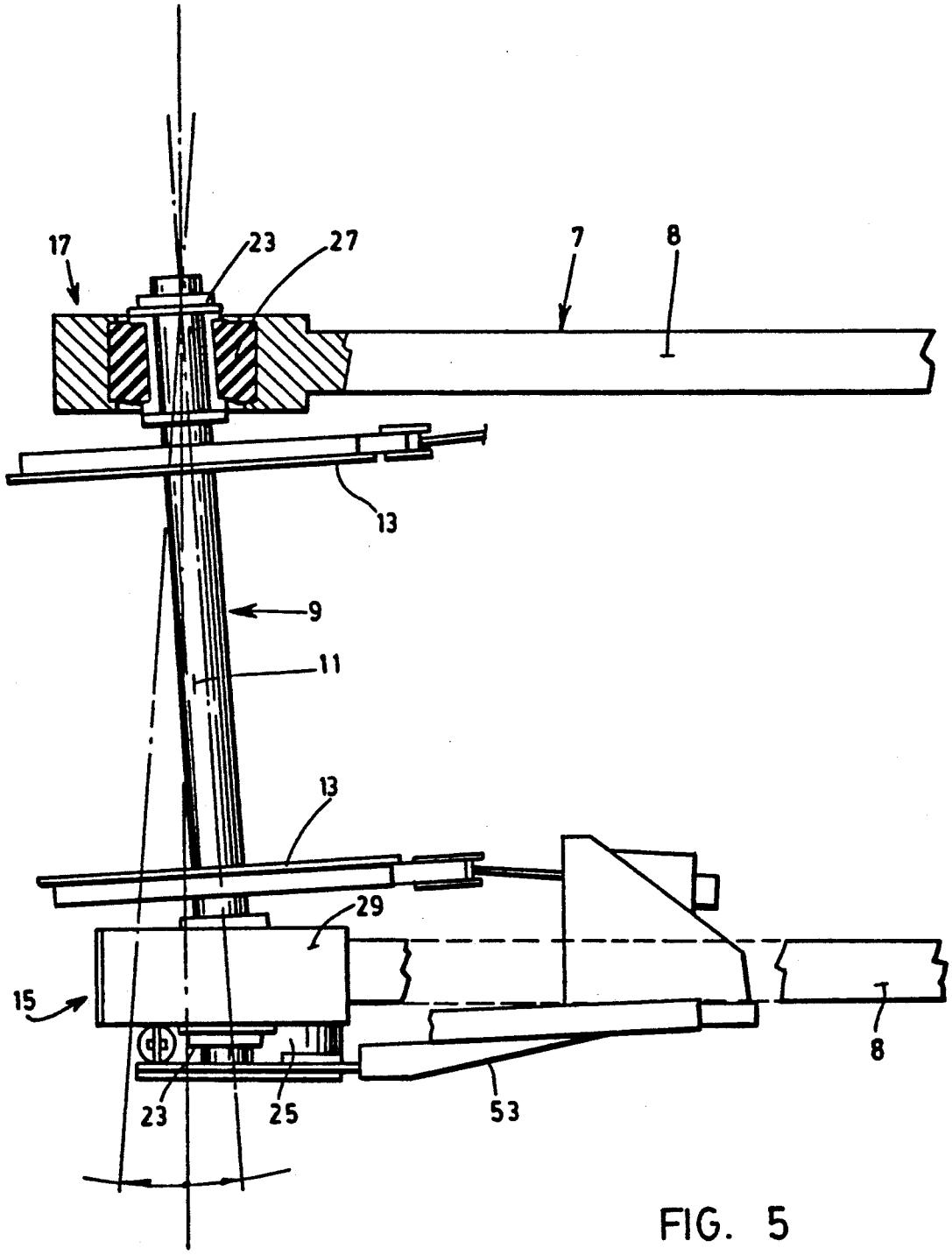
FIG. 5 is a view similar to FIG. 4, when the front wheel assembly is steered to the left.
Figure 9:
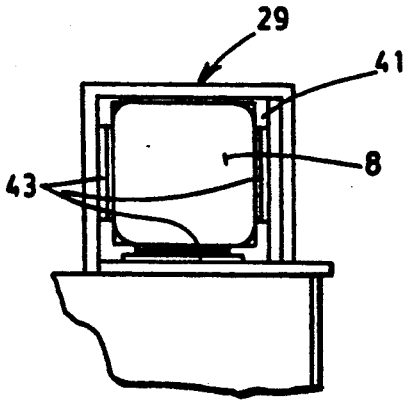
FIG. 9 is a cross-sectional view of the right side of the rail-bogie of FIGS. 1 to 5, taken along line IX—IX in FIG. 2.

As better shown in FIGS. 4 and 9, the bearing structure 29 of the supporting assembly 15 is slidably mounted on the chassis and includes a longitudinal sleeve 41 sized and positioned to fit onto the corresponding side beam 8. As may be understood, the side beam 8 together with the sleeve 41 in which it extends, form the above mentioned slide means. As shown in FIG. 9, a set of wear plates 41 may be provided within the sleeve 41 to hold the beam 8 tight therein.

Referring now to FIGS. 1 to 3 and 6, the steering means also comprises an operating arm 43 having one end 45 attachable by a ball to the frame of the semi-trailer 3 close to the supporting assembly 15 slidably mounted onto the chassis, at a distance away from the vertical rotation axis of this frame, which is the king pin held by the fifth-wheel 33. The operating arm 43 has another end 47 connected via a linking mechanism to the above mentioned supportingly assembly for moving the supporting assembly 15 in such a direction as to cause the axle 9 held by the supporting assembly 15 to pivot in the same direction but at an angle smaller than and proportional to the frame of the semi-trailer 3 with respect to the chassis 7 (see FIG. 7).

Figure 2:
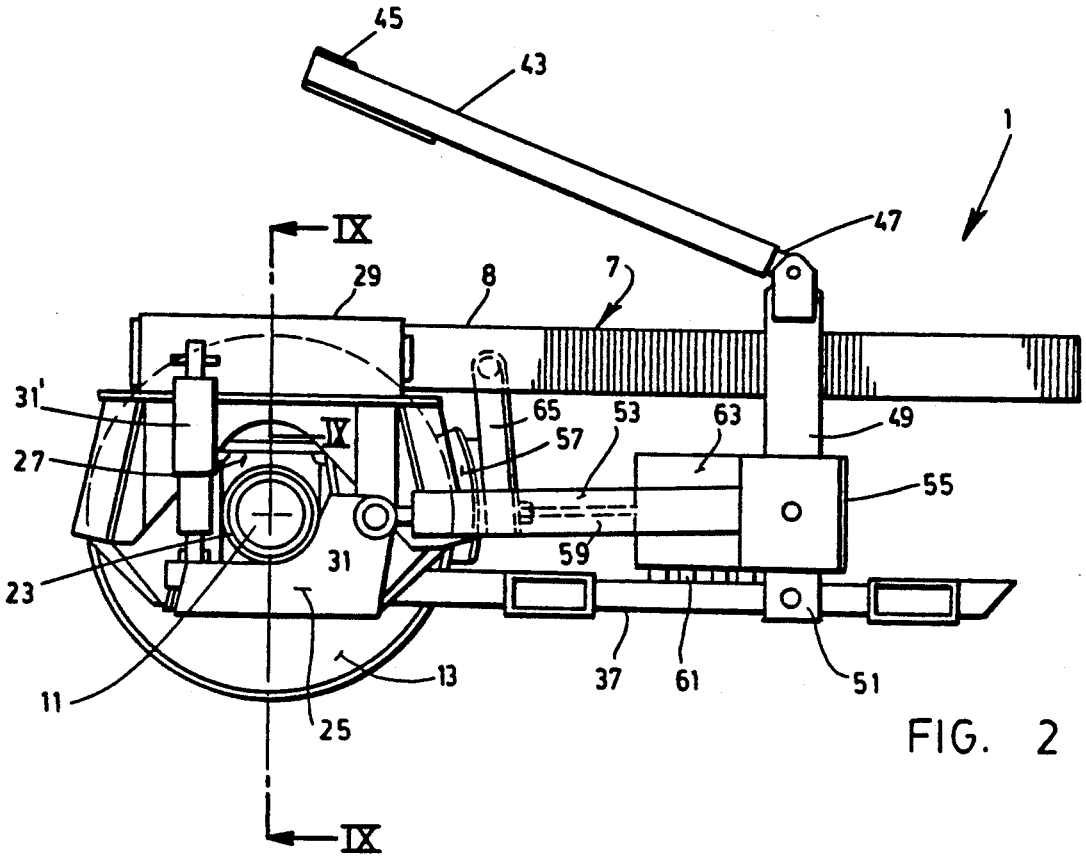
FIG. 2 is a side elevational view of the rail-bogie of FIG. 1, showing the position of the steering means of the front wheel assembly when this assembly is in its normal transverse position.
Figure 3:
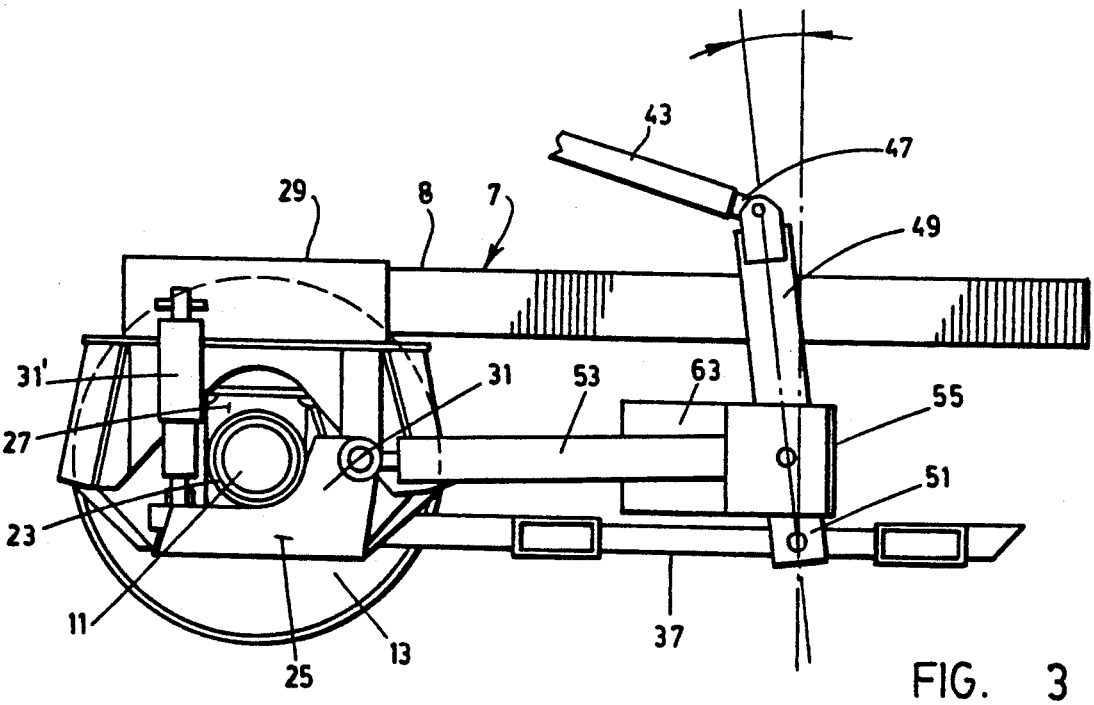
FIG. 3 is a view similar to FIG. 2 showing the position of the steering means of the front wheel assembly when this assembly is steered to the right.

As better shown in FIGS. 2 and 3, the linking mechanism connecting the operating arm 43 to the slide means comprises an operating lever 49 extending generally vertically and having an upper end pivotably connected to the end 47 of the operating arm 43, and a lower end 51 pivotably fixed to the adjacent side of the floor 37 of the chassis. The linking mechanism also comprises a connecting link 53 having one end 55 pivotably connected to the operating lever 49 between the upper and lower end thereof, and another end connected to the pivot axis 31 of the box supporting member 25 of the supporting assembly 15 slidably mounted onto the chassis 7.

As is shown with arrows in FIG. 3, the required proportional steering of the axle 9 is achieved by proper selection of the position where the one end 55 of the connecting link 53 is connected to the operating lever 49 between the upper and lower ends thereof. The distance between the ball 45 on the trailer and the king pin which is also on the trailer and engages the fifth wheel 33, also controls the amount of steering.

In practice, steering of the axle 9 is preferably selected to optimize dynamic behavior of the semi-trailer or wagon, and the rail-bogies.

As is shown in FIGS. 1, 2 and 4, braking means may be provided for braking the wheels 13, 13'. Each of the braking means include a friction pad 57 fixed to the end of the piston rod 59 of a pneumatic actuator 61 which, when it is actuated, presses the pad against the corresponding wheel.

These braking means are rigidly mounted on the chassis 7 in a manner known per se except for the one used for braking the wheel 13 adjacent the supporting assembly 15 slidably mounted on the chassis 7, which is mounted on a supporting plate member 63 rigidly fixed to the connecting link of the linking mechanism so as to be moved in unison with the supporting assembly 15 and thus remains in operative position with respect to the adjacent wheel 13. As is shown in FIG. 2, the piston rod 59 and friction pad 57 of the braking means of the slidable assembly 15 are connected to the bottom end of a lever 65 which is pivotably fixed in a free manner to the chassis 7 and whose purpose is essentially to hold them in operative position relative to the wheel 13.

In accordance with the invention, the bogie 1 may be provided which only one steering means of the type disclosed hereinabove. However, for the purpose of better wheel and rail interface and improved dynamics, the bogie 1 is preferably provided with two steering means for steering each of the two wheel assemblies. In such a case, the steering means of the wheel assembly 15 which is the nearest to the semi-trailer 3 has its operating arm 43 pivotably connected to the rear end of the frame of the semi-trailer 3 to slide the supporting assembly 15 whereas the steering means of the other wheel assembly which is close to the other semi-trailer 3' hooked to the bogie has its operating arm 43' pivotably connected to the front end of the frame of this other semi-trailer 3' to slide the diagonally opposite supporting assembly 19 (see FIG. 7).

We claim:

1. An improved twin-axle rail-bogie of the type comprising:

a chassis having a longitudinal axis;

a pair of railboard wheel assemblies each comprising an axle normally in a transverse position and on which a pair of rail-engaging wheels are mounted;

first mounting means comprising four axle end supporting assemblies for mounting said wheel assemblies under said chassis, each of said supporting assemblies comprising a journal box in which one end of one of said axles is mounted, and a box-supporting member onto which said journal box is connected through a resilient bushing; and second mounting means for pivotably mounting at least one end of a vehicle on top of said chassis so that said at least one end of the vehicle is free to rotate about a vertical axis which intersects said longitudinal axis;

the improvement wherein said rail-bogie further comprises:

means for steering one of said wheel assemblies proportionally to a degree of rotation about said vertical axis of said at least end of the vehicle pivotably mounted on top of the chassis, said steering means including:

(a) slide means forming an integral part of said first mounting means, for slidably mounting one of said axle end supporting assemblies onto said chassis so that said one supporting assembly is longitudinally slidable and thus causes the one axle having one of its ends connected thereto to pivot forward or rearward out of its normal transverse position about the transversely opposite supporting assembly holding the opposite end of said one axle, said opposite supporting assembly acting as a pivot about the resilient bushing which gives some slack to the journal box in which said opposite end of the one axle is mounted; and (b) an operating arm having one end attached to the vehicle close to the one supporting assembly slidably mounted onto the chassis, at a distance away from the vertical axis of said at least one end of said vehicle, and another end connected via a linking mechanism to the one supportingly assembly for moving said one supporting assembly in such a direction as to cause the one axle held by said one supporting assembly to pivot in the same direction but at a smaller angle than said one end of said vehicle with respect to said chassis.

2. The improved rail-bogie of claim 1, wherein said linking mechanism comprises:

an operating lever extending generally vertically and having an upper end pivotably connected to the other end of the operating arm and a lower end pivotably fixed to said chassis; and a connecting link having one end pivotably connected to the operating lever between the upper and lower ends thereof and another end connected to the one supporting assembly slidably mounted onto the chassis.

3. The improved rail-bogie of claim 2, wherein said slide means comprises a bearing structure connected to the chassis; and a shock absorber is mounted between said bearing structure and said box-supporting member, at a distance away from the rotational axis of the axle in connection with said box-supporting member.

4. The improved rail-bogie of claim 3, wherein:

the chassis comprises a pair of longitudinal side beams symmetrical with respect to said longitudinal axis; and the bearing structure, in connection with the one supporting assembly slidably mounted on the chassis, includes a longitudinal sleeve sized and positioned to fit onto the corresponding side beam, said corresponding side beam together with the sleeve in which it extends forming said slide means.

5. The improved rail-bogie of claim 4, further comprising:

braking means for braking said wheels, each of said braking means including a friction pad and a piston rod for pressing the pad against the corresponding wheel, said braking means being mounted on said chassis except for the one used for braking the wheel adjacent the one supporting assembly slidably mounted on said chassis, said one braking means being mounted on the connecting link of the linking mechanism so as to be moved in unison with the one supporting assembly and thus remains in operative position with respect to the adjacent wheel.

6. The improved rail-bogie of claim 5, adapted for hooking with semi-trailers to form a train for riding on rails, each of said semi trailers being provided with front and rear king pins projecting downwardly from the front and rear ends of the semi-trailer, respectively, wherein said second mounting means comprises:

first and second fifth wheels mounted on a supporting frame on said chassis, said first and second fifth-wheels being oppositely oriented, one of said first and second fifth wheels being interlocked with the front king pin of one trailer while the other one of said fifth-wheels is interlocked with the rear king pin of another trailer.

7. The improved rail-bogie of claim 6, comprising two of said steering means, one for each of said two wheel assemblies, the steering means of the wheel assembly which is the nearest to the one trailer having its operating arm pivotably connected to the front end of the one trailer, the steering means of the other wheel assembly which is close to the other trailer having its operating arm pivotably connected to the rear end of the other trailer.

* * * * *